US012458146B2

(12) United States Patent
Murphy

(10) Patent No.: US 12,458,146 B2
(45) Date of Patent: Nov. 4, 2025

(54) RECLINING CHAIR WITH TILTING ACTION TO PROVIDE HEART-REST POSITION

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 246 days.

(21) Appl. No.: 18/350,122

(22) Filed: Jul. 11, 2023

(65) Prior Publication Data

US 2024/0023713 A1 Jan. 25, 2024

Related U.S. Application Data

(60) Provisional application No. 63/391,052, filed on Jul. 21, 2022.

(51) Int. Cl.
*B60N 2/02* (2006.01)
*A47C 1/02* (2006.01)
*A47C 1/034* (2006.01)

(52) U.S. Cl.
CPC ..... *A47C 1/0345* (2013.01)

(58) Field of Classification Search
CPC ... A47C 1/0345; A47C 1/0355; A47C 1/0347; A47C 1/035; A47C 3/027; A47C 7/5068; A47C 1/03211; A47C 1/0352; A47C 7/506; A47C 1/0242; A47C 1/0342; A47C 17/163; A47C 3/0255; A47C 1/0244; A47C 1/03205; A47C 1/034; A47C 1/037; A47C 1/143; A47C 17/04; A61H 2201/0149
See application file for complete search history.

(56) References Cited

U.S. PATENT DOCUMENTS 5,348,367 A 9/1994 Mizelle
6,793,279 B2 * 9/2004 Hoffman ..... G06F 17/142 297/354.13
7,114,770 B2 10/2006 Murphy
8,506,009 B2 8/2013 Lapointe et al.
8,752,890 B2 6/2014 Murphy et al.
(Continued)

FOREIGN PATENT DOCUMENTS

WO 2010132420 A1 11/2010

OTHER PUBLICATIONS

"International Preliminary Report on Patentability corresponding to PCT/US2023/069850 mailed Jan. 30, 2025".
(Continued)

*Primary Examiner* — Shin H Kim
(74) *Attorney, Agent, or Firm* — Myers Bigel, P.A.

(57) ABSTRACT

A reclining seating unit includes: a frame having a pair of arms; a backrest; a seat; a first footrest; a reclining mechanism connected between the backrest, seat, and first footrest configured to move the seating unit between an upright position, a TV position, and a fully reclined position. A heart-rest mechanism is mounted to the frame and to the reclining mechanism and is configured to move the seating unit between the fully reclined position and a heart-rest position, wherein the backrest maintains the second backrest angle relative to the seat, the first footrest remains in front of the seat, and the seat and first footrest are elevated compared to the fully reclined position.

20 Claims, 15 Drawing Sheets

(56) References Cited

U.S. PATENT DOCUMENTS

| | | | | |
|---|---|---|---|---|
| 8,915,544 | B2 | 12/2014 | Lapointe | |
| 9,603,453 | B2 | 3/2017 | Hoffman et al. | |
| 10,709,246 | B2 * | 7/2020 | Murphy ..... | A47C 1/0345 |
| 11,122,898 | B2 | 9/2021 | Kiwak et al. | |
| 2003/0015893 | A1 | 1/2003 | Hoffman et al. | |
| 2012/0286557 | A1 | 11/2012 | Hoffman et al. | |

OTHER PUBLICATIONS

International Search Report and Written Opinion corresponding to PCT/US2023/069850; Dated: Nov. 1, 2023, (13 pages).

* cited by examiner

RECLINING CHAIR WITH TILTING ACTION TO PROVIDE HEART-REST POSITION

RELATED APPLICATION

The present application claims priority from, and the benefit of, U.S. Provisional Patent Application No. 63/391,052, filed Jul. 21, 2022, the disclosure of which is hereby incorporated herein by reference in full.

FIELD OF THE INVENTION

The present invention is directed to furniture, and more particularly to seating units for the health care industry.

BACKGROUND OF THE INVENTION

The advent of home health care has created a need for furniture that provides functional features for the patient as well as more conventional function for others. For example, chairs exist that are capable of reclining in a number of positions in the same manner as traditional, non-medical recliner chairs while being movable to a "heart-rest" position (also known as the Trendellenburg position). The heart-rest position is one in which the occupant of the chair is postured such that his legs are elevated to a height equal to or above his heart, with the result that blood is encouraged to flow to the heart rather than pooling in the legs. This position is often used to treat shock (particularly during dialysis treatments).

One exemplary chair that combines reclining capability with the capacity to move to the heart-rest position is discussed and illustrated in U.S. Pat. No. 5,348,367 to Mizelle. The Mizelle chair includes a relatively simple six-bar linkage system and can stop in any intermediate position between an upright and a fully reclined position. An attendant can then lift the front of the seat frame of the chair to bring the chair into a "heart-rest" position in which the seat frame, back frame and leg rest assume "the position of a lounge chair that has been tilted approximately 45 degrees." Another exemplary chair, available from Lumex, Inc., utilizes a reclining mechanism from a conventional residential reclining chair. In this chair, the reclining mechanism is configured such that, once the chair is in a fully reclined position (i.e., one in which the backrest and seat have pivoted relative to one another so that the angle therebetween increases), a foot pedal can release the mechanism to continue its reclining motion, with the angle between the backrest and the seat continuing to increase. As a result, the heart-rest position of this chair provides a support surface in which mimics that of a hospital bed. Another exemplary chair, discussed in U.S. Patent Publication No. 2003/0015893 to Hoffman et al., also utilizes a mechanism from a conventional three-way reclining chair. The chair can move from the fully reclined position to the heart-rest position by pivoting relative to the frame, such that the backrest and seat maintain a similar angle to one another; this pivoting movement is actuated by a foot pedal. Still further exemplary chairs with heart-rest position capability are discussed in U.S. Pat. No. 7,114,770 to Murphy and U.S. Pat. No. 9,603,453 to Hoffman et al.

In view of the foregoing, additional configurations for health care chairs may be desirable.

SUMMARY OF THE INVENTION

As a first aspect, embodiments of the invention are directed to a reclining seating unit. The reclining seating unit comprises: a frame having a pair of arms; a backrest; a seat; a first footrest; a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position; and a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position.

As a second aspect, embodiments of the invention are directed to a reclining seating unit comprising: a frame having a pair of arms; a backrest; a seat; a first footrest; a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position; a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position; and a single power linear actuator coupled to the reclining mechanism and to the heart-rest mechanism configured to drive the chair between the upright, TV, fully reclined and heart-rest positions.

As a third aspect, embodiments of the invention are directed to a reclining seating unit comprising: a frame having a pair of arms; a backrest; a seat; a first footrest; a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position; and a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position. The reclining mechanism includes a foundation link, wherein the heart-rest mechanism is coupled to the foundation link, wherein the foundation link is stationary relative to the frame as the seating unit moves between the upright, TV and fully reclined positions, and wherein, when moving from the fully reclined position to the heart-rest position, the foundation link moves forwardly and upwardly relative to the frame. The seating unit further comprises a power linear actuator coupled to the reclining mechanism and to the heart-rest mechanism configured to drive the chair between the upright, TV, fully reclined and heart-rest positions.

DETAILED DESCRIPTION OF EMBODIMENTS OF THE INVENTION

Figure 1:
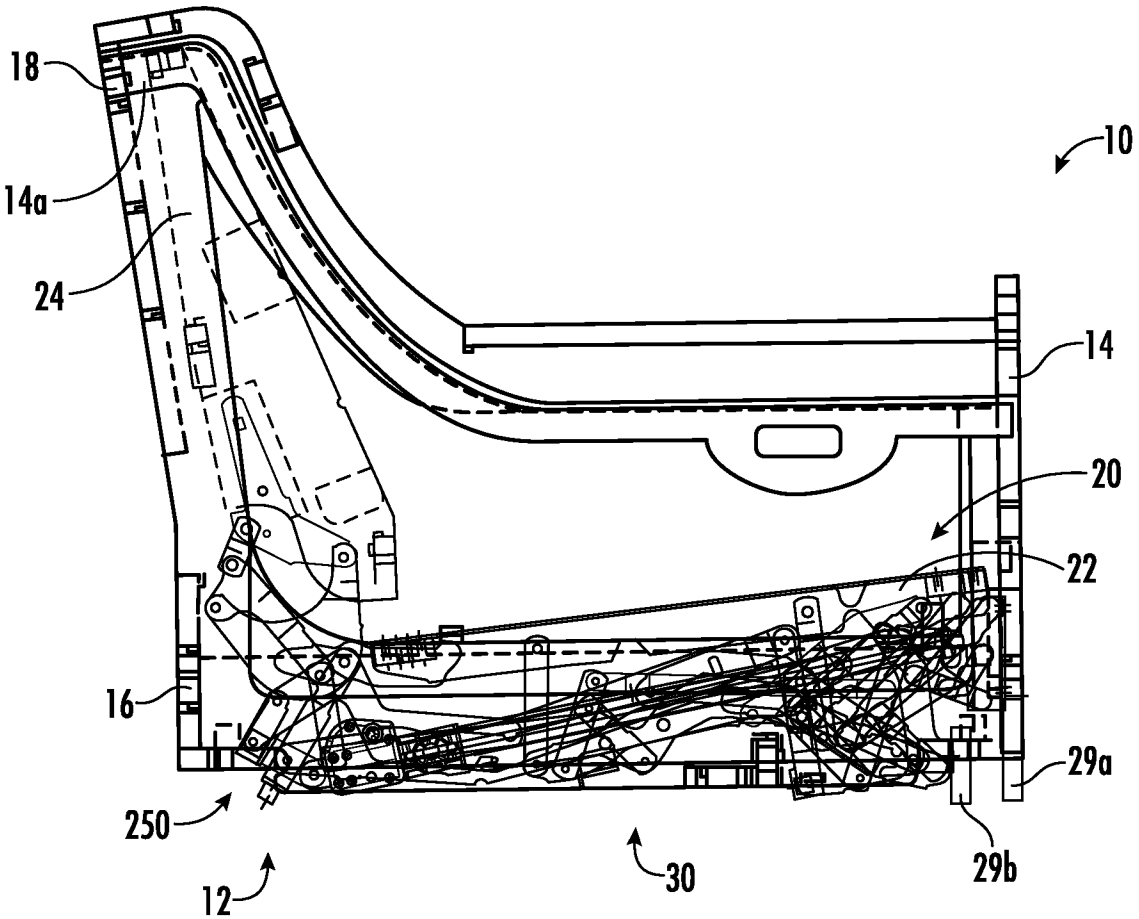
FIG. 1 is a cutaway side view of a reclining chair with heart-rest capability according to embodiments of the invention, with the chair shown in the upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the figures, a reclining wall-avoiding chair, designated broadly at 10, is shown in FIGS. 1-11. The chair 10 includes a frame 12 having two opposed arms 14 connected by multiple cross-members 16. Specifically, the frame 12 includes an upper cross-member 18 that spans upper end portions 14*a* of the arms 14. The chair also includes a seat 20 with a cushion (not shown) that overlies a seat frame 22, a backrest 24, and main and auxiliary footrests 29*a*, 29*b* (see FIGS. 1 and 11).

Figure 2:
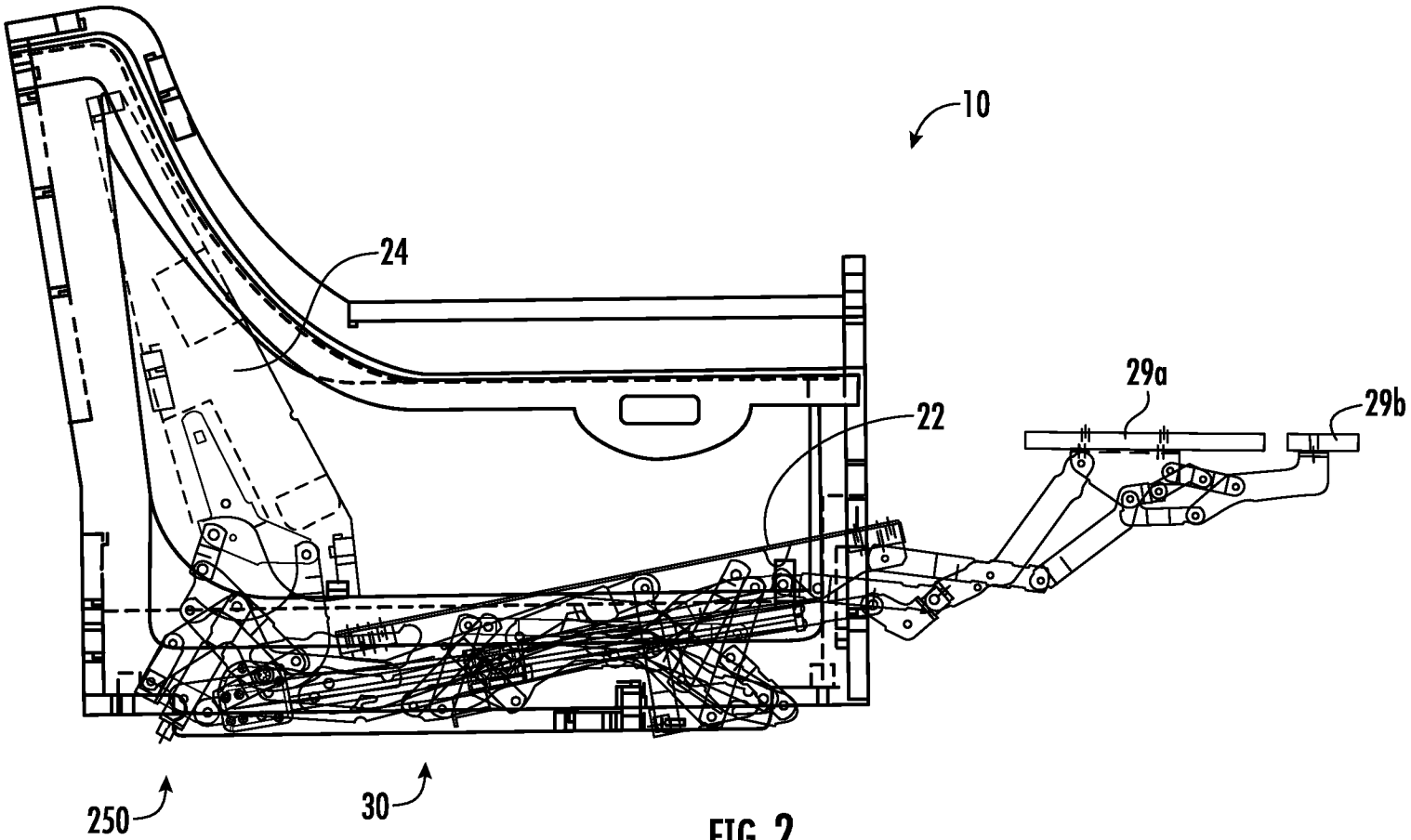
FIG. 2 is a cutaway side view of the chair of FIG. 1, shown in the TV position.
Figure 3:
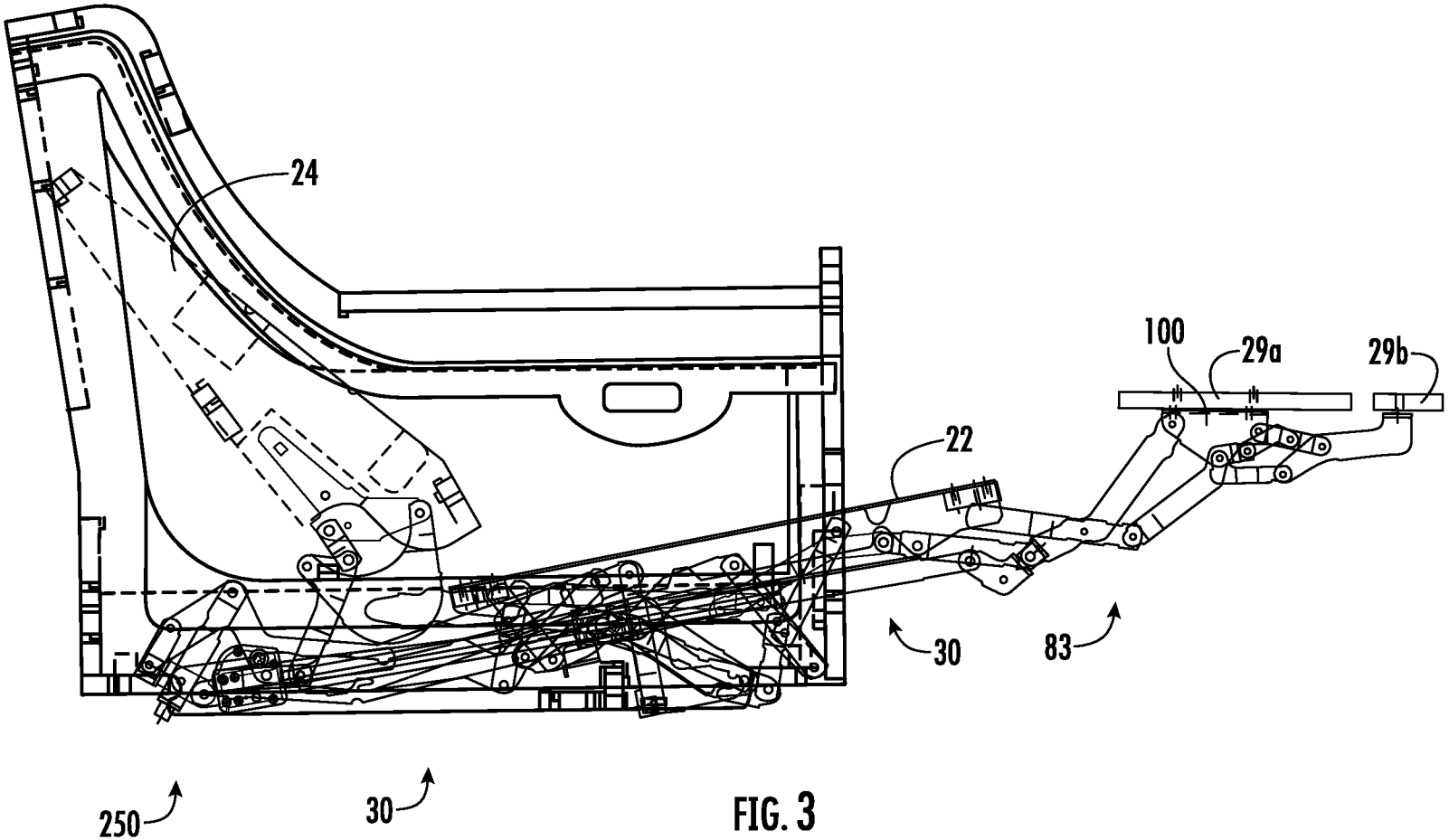
FIG. 3 is a cutaway side view of the chair of FIG. 1, shown in the fully reclined position.
Figure 6:
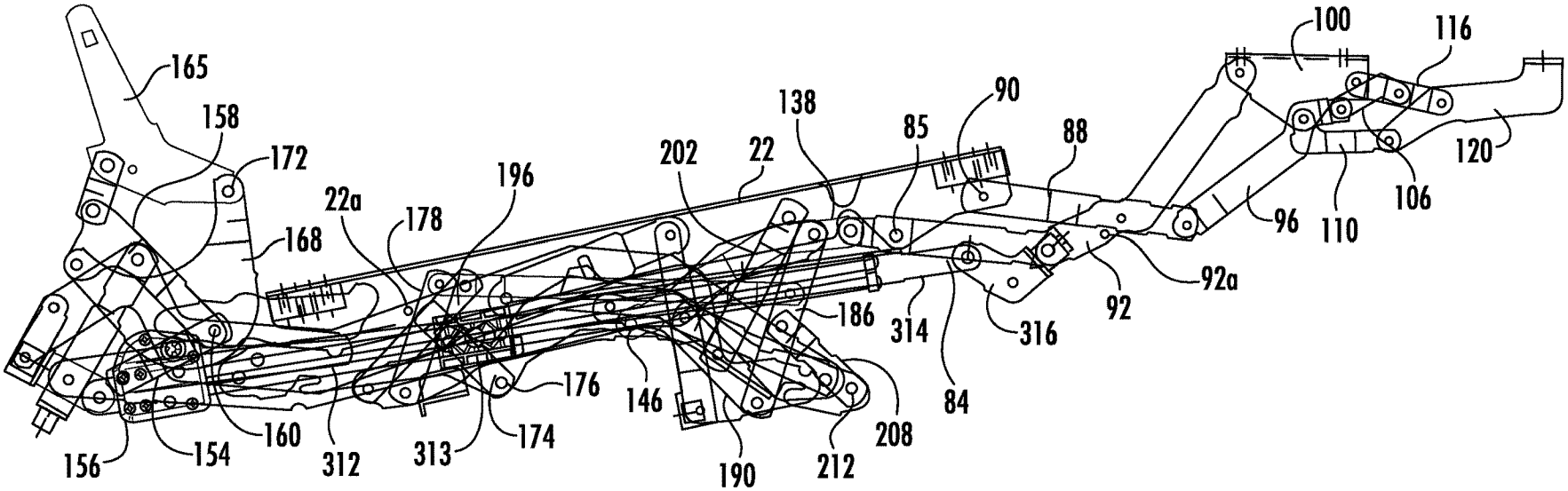
FIG. 6 is a side view of the reclining and heart-rest mechanisms of the chair of FIG. 1, shown in the TV position.
Figure 7:
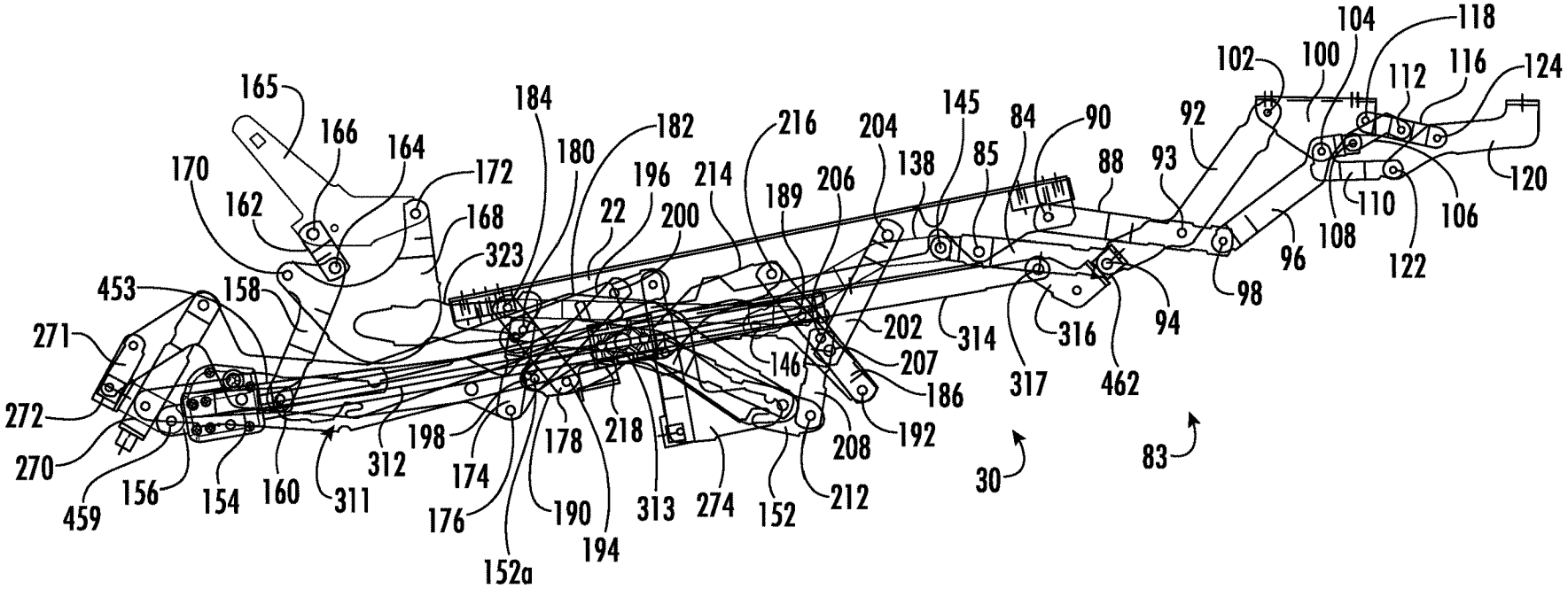
FIG. 7 is a side view of the reclining and heart-rest mechanisms of the chair of FIG. 1, shown in the fully reclined position.

The seat 20, the backrest 24 and the footrests 29*a*, 29*b* are interconnected by two mirror image reclining mechanisms 30 that enable the chair 10 to move between an upright position (FIGS. 1 and 5), a TV position (FIGS. 2 and 6), and a fully reclined position (FIGS. 3 and 7). The reclining mechanisms 30 are mirror images of each other about a longitudinal vertical plane P that divides the chair into left and right sides (see FIG. 11). As such, only one reclining mechanism 30 will be discussed in detail herein, with the understanding that the discussion is equally applicable to its minor image mechanism. The reclining mechanism 30 will be first described below with respect to a fully reclined position (FIGS. 3 and 7) in order to illustrate more easily the interconnection of the various links thereof.

Figure 4:
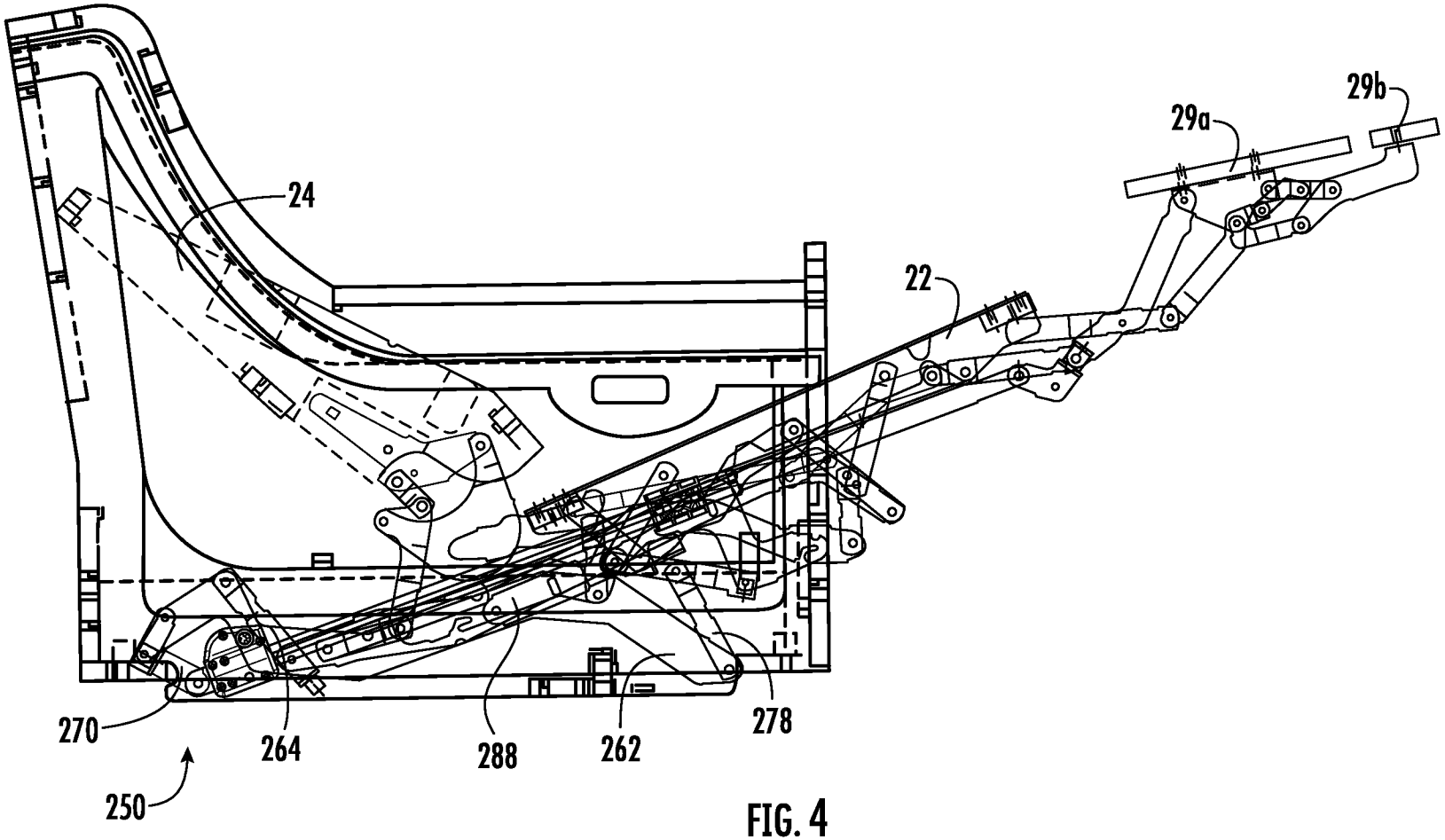
FIG. 4 is a cutaway side view of the chair of FIG. 1, shown in the heart-rest position.
Figure 8:
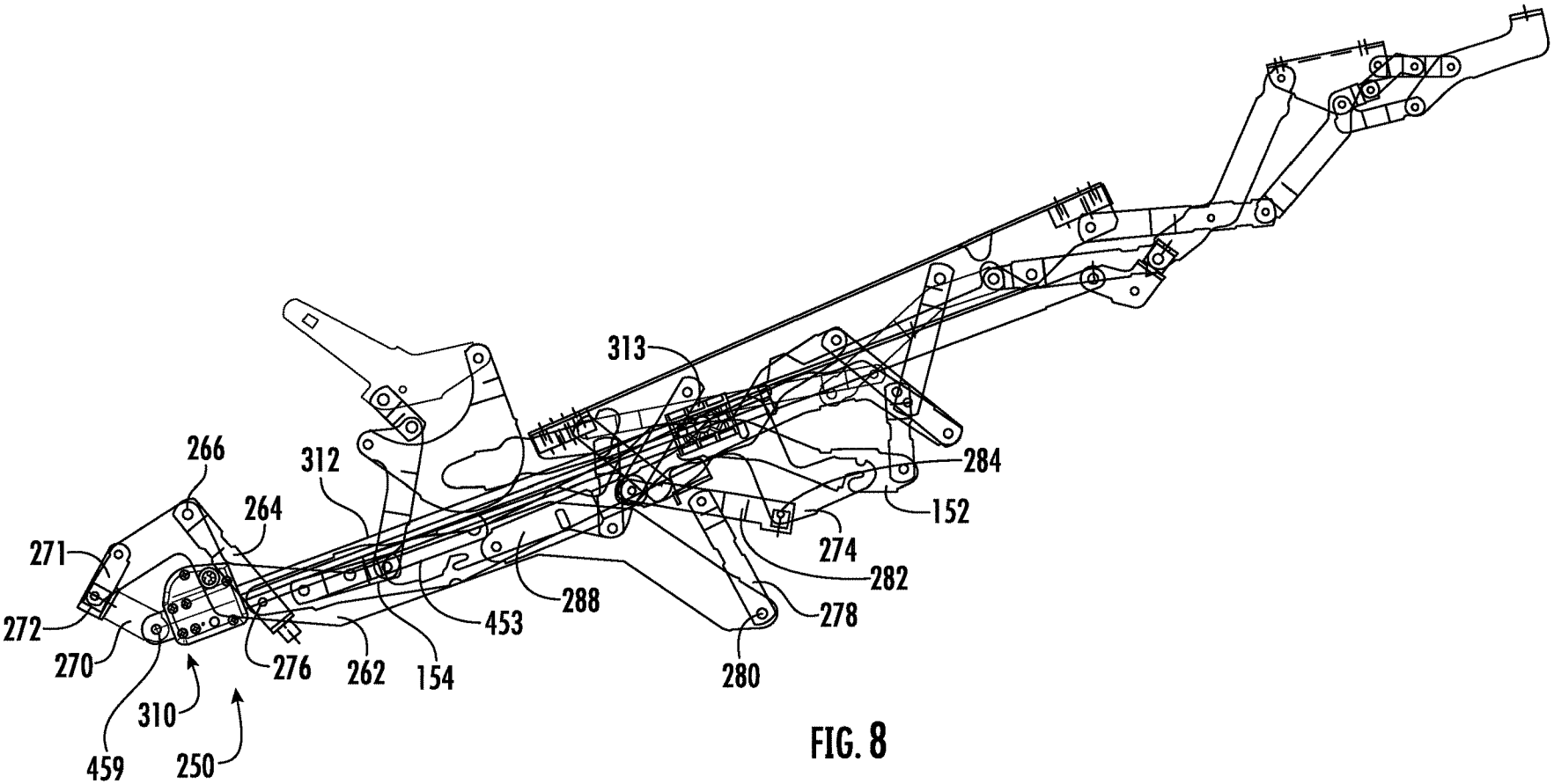
FIG. 8 is a side view of the reclining and heart-rest mechanisms of the chair of FIG. 1, shown in the heart-rest position.
Figure 9:
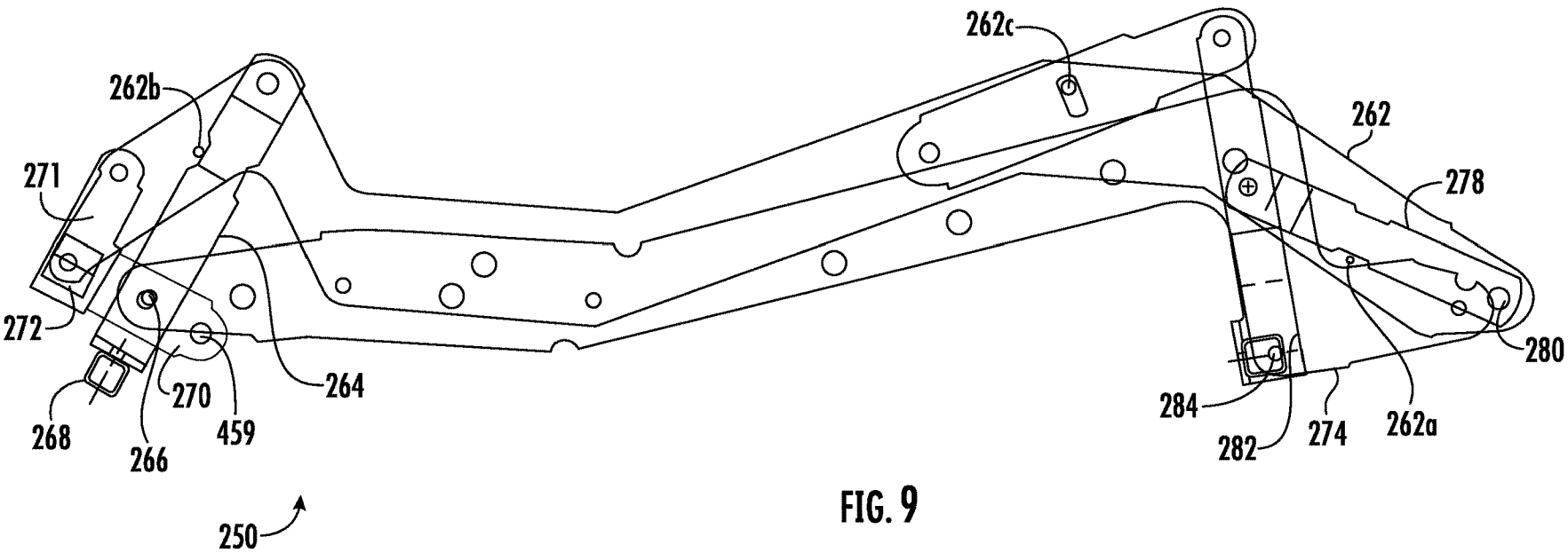
FIG. 9 is a side view of the heart-rest mechanism of the chair of FIG. 1, shown in its disposition in the upright, TV and fully reclined positions.

In addition, the chair 10 includes two minor image heart-rest mechanisms 250 that are mounted to the frame 12 and to the reclining mechanisms 30 that enable the chair 10 to move from the fully reclined position of FIGS. 3 and 7 to a heart-rest position (FIGS. 4 and 8). The heart-rest mechanism 250 will be described first with respect to the heart-rest position (FIGS. 4, 8 and 10) for clarity. Thus, together, the reclining mechanisms 30 and the heart-rest mechanisms 250 combine to move the chair between the upright, TV, fully reclined, and heart-rest positions.

Figure 10:
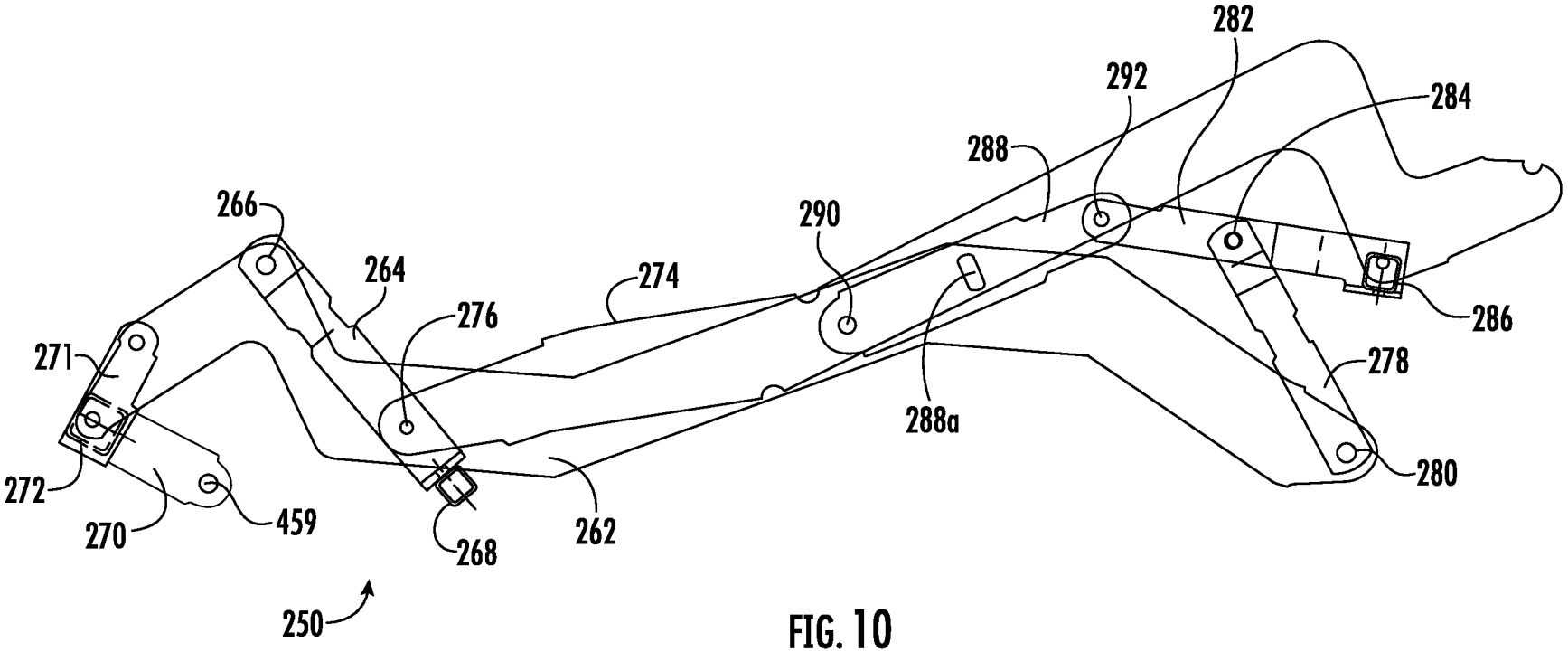
FIG. 10 is a side view of the heart-rest mechanism of the chair of FIG. 1, shown in its disposition in the heart-rest position.

Referring now to FIGS. 4, 8 and 10, the heart-rest mechanism 250 includes a mounting link 262 that is fixed to the inner surface of the arm 14. A finger 271 is fixed to the rear end of the mounting link 262; a cross-member 272 extends between the fingers 271 on opposite sides of the chair 10. A rear swing link 264 is attached to a rear area of the mounting link 262 at a pivot 266 and extends downwardly and forwardly therefrom. The lower ends of the rear swing links 264 are spanned by a cross-member 268. A heart-rest carriage link 274 is mounted at its rear end to a lower portion of the rear swing link 262 at a pivot 276 and extends generally forwardly and slightly upwardly therefrom. A front swing link 278 is attached to the front end of the mounting link 262 at a pivot 280. A lifting link 282 is attached at a middle section thereof to the upper end of the front swing link 278 at a pivot 284. A cross-member 286 extends between the lower ends of the lifting links 282. A control link 288 is attached to a central portion of the mounting link 262 at a pivot 290 and to the rear end of the lifting link 282 at a pivot 292. A slot 288*a* in the control link 288 receives a pin 262*c* on the mounting link 262.

Referring now to FIGS. 3 and 7, the reclining mechanism 30 includes a foundation link 152 that is fixed to the inner surface of the heart-rest carriage link 274 to provide mounting locations for multiple links of the reclining mechanism 30. A lower rear swing link 154 is mounted to an extension 453 on the foundation link 152 at a pivot 156 and extends forwardly and slightly upwardly therefrom. An angled upper rear swing link 158 is attached at its lower end to the lower rear swing link 154 at a pivot 160 and extends upwardly and slightly forwardly therefrom. A control link 162 is attached at its lower end to the vertex of the upper rear swing link 158 at a pivot 164 and extends upwardly and slightly rearwardly to a pivot 166 with a backpost 165 fixed to the backrest 24. A saddle-shaped extension 168 is fixed to the rear end of the seat frame 22 via a fixed finger 323; the extension 168 is attached to the backpost 165 at a pivot 172 and to the upper end of the upper rear swing link 158 at a pivot 170.

A rear recline link 174 is attached to the foundation link 152 at a pivot 176 and extends upwardly and slightly forwardly therefrom. A transition link 178 is attached at an intermediate location to the upper end of the rear recline link 174 at a pivot 180. The lower end of the transition link 178 is attached to a carrier link 190 at a pivot 194. The upper end of the transition link 178 is attached at a pivot 184 to the rear end of a coupling link 182.

A front recline link 208 is attached at its lower end to the forward end of the foundation link 152 at a pivot 212. At its upper end, the front recline link 208 is attached to an intermediate location of a drawing link 186 at a pivot 206. The drawing link 186 is attached at its lower end to the carrier link 190 at a pivot 192. The forward end of the coupling link 182 is attached to a central position on the drawing link 186 at a pivot 189. At its upper end, the drawing link 186 is attached to a drive link 214 at a pivot 216. The drive link 214 is attached at its rear end to the foundation link 152 at a pivot 218. A rear seat swing link 196 is attached to the rear end of the carrier link 190 at a pivot 198 and to the seat frame 22 at a pivot 200. A forward seat swing link 202 is attached to the carrier link 190 at a pivot 207 and to the seat frame 22 at a pivot 204.

The reclining mechanism 30 also includes a footrest linkage 83 with a lower footrest swing link 84 that is attached to the seat frame 22 at a pivot 85 and extends forwardly therefrom. The lower footrest swing link 84 is also attached at its upper end to a footrest drawing link 138 at a pivot 145. The footrest drawing link 138 is also attached to the carrier link 190 at a pivot 146. An upper footrest swing link 88 is also attached to the seat frame 22 at a pivot 90 and extends forwardly therefrom. An upper footrest extension link 92 is attached to the forward end of the lower footrest swing link 84 at a pivot 94 and extends upwardly and forwardly therefrom. The upper footrest extension link 92 is also attached to the upper footrest swing link 88 at a pivot 93. A lower footrest extension link 96 is attached to the forward end of the upper footrest swing link 88 at a pivot 98 and extends forwardly and upwardly therefrom. A main footrest bracket 100 is attached to the forward ends of the upper footrest extension link 92 and the lower footrest extension link 96 at, respectively, pivots 102, 104. The main footrest 29*a* is mounted on the main footrest bracket 100 (FIG. 3).

A lower auxiliary footrest swing link 110 is attached to the main footrest bracket 100 at the pivot 104, and an upper auxiliary footrest swing link 116 is attached to the main footrest bracket 100 at a pivot 118. An auxiliary footrest bracket 120 is attached to the front ends of the swing links 110, 116 at, respectively, pivots 122, 124. A control link 106 is attached to the forward end of the lower footrest extension link 96 at a pivot 108 and to the upper auxiliary footrest swing link 116 at a pivot 112. The auxiliary footrest 29*b* is mounted on the auxiliary footrest bracket 120 (FIG. 3).

An electric linear actuator 311 drives the chair 10 between the upright, TV, fully reclined, and heart-rest positions, and also enables the chair 310 to be moved to any position between the upright position (FIGS. 1 and 5) and the heart-rest position (FIGS. 4 and 8). The linear actuator 311 includes a rail 312 and a carriage 313 that is driven along the rail 312 (e.g., via a motor and drive screw or the like). At its rear end, the rail 312 is attached to a flange link 270 at a pivot 459. The cross-member 272 that extends between extensions 271 that are fixed to the mounting links 262 on either side of the chair 310. The lower rear swing link 154 is attached to the rear end of an extension 453 fixed relative to the heart-rest carriage link 274 and the foundation link 152. The flange link 270 is fixed to and extends forwardly from the cross-member 272. A drive member 314 is fixed to the carriage 313 and extends forwardly therefrom. The drive member 314 is pivotally attached at a pivot 317 to a crank 316, which is fixed to a cross-member 462. The cross-member 462 is fixed to and extends between the lower footrest swing links 84. The linear actuator 311 is operably connected to a power source, which may be a battery, an electrical outlet accessible via a power cord, or the like. The linear actuator 311 may also be connected to a control unit (e.g., a keypad, joystick, toggle switch, button, etc.) that initiates and ceases movement of the carriage 313 relative to the rail 312.

Figure 5:
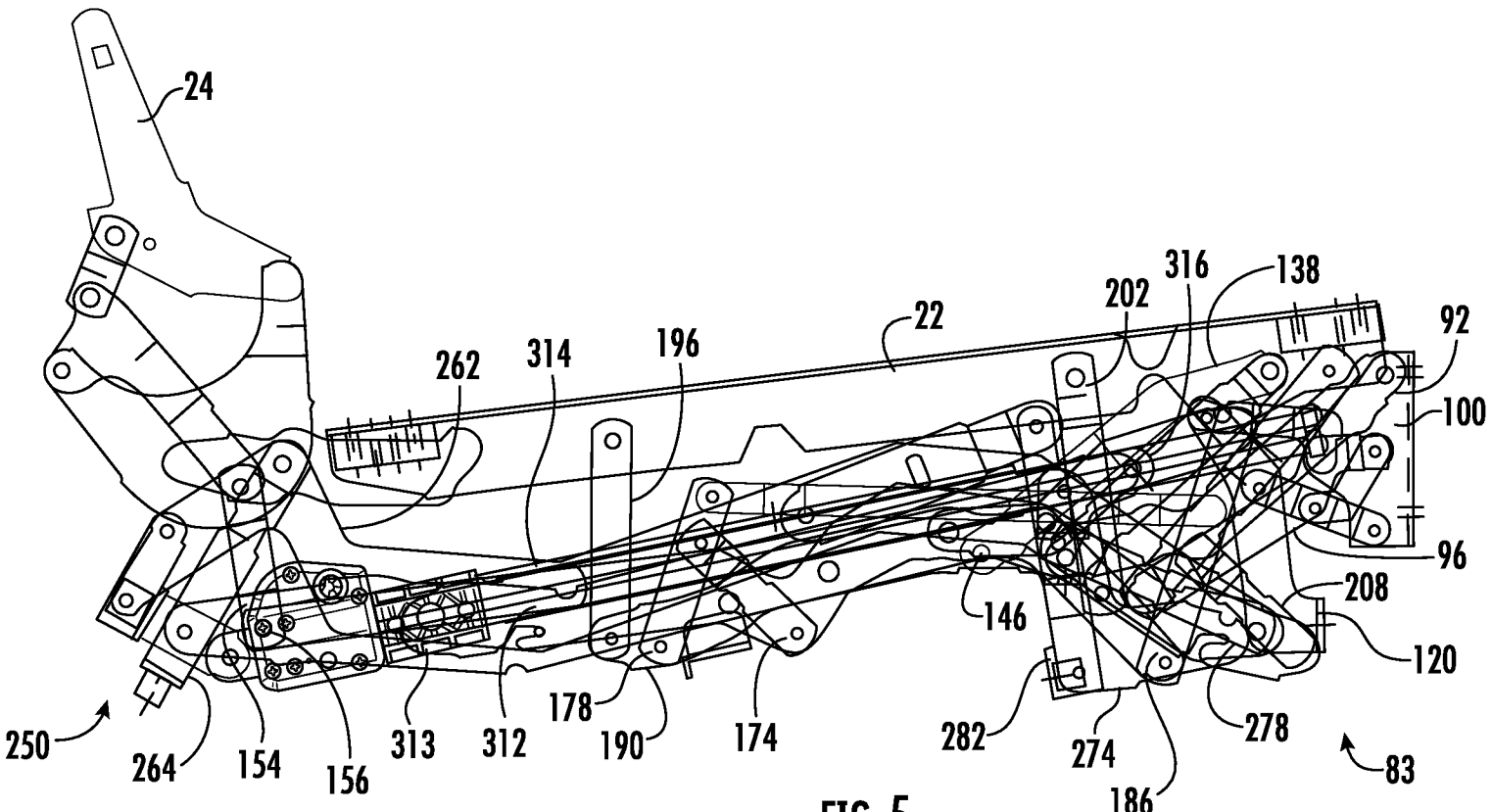
FIG. 5 is a side view of the reclining and heart-rest mechanisms of the chair of FIG. 1, shown in the upright position.

Operation of the chair 10 typically commences with the chair 10 in the upright position of FIGS. 1 and 5. In the upright position, the heart-rest mechanism 250 is arranged with the mounting link 262 and the heart-rest carriage link 274 (which, as described above, is fixed to the foundation link 152 of the reclining mechanism 30) generally aligned with each other (i.e., their front and rear ends are generally in the same longitudinal location—see FIG. 9). The rear swing link 264 is extends forwardly and upwardly from the pivot 266, and the front swing link 278 extends rearwardly and slightly upwardly from the pivot 280. The lifting link 282 extends upwardly and slightly rearwardly from the pivot 284. The lower edge of the front swing link 278 engages a pin 262*a* on the mounting link 262, and the rear surface of the rear swing link 262 engages a pin 262*b*; the interaction of the pins 262*a*, 262*b* with the front and rear swing links 264, 278 prevents unwanted rotation of these links beyond the illustrated positions and therefore helps to maintain the heart-rest mechanism 250 in position as the reclining mechanism 30 operates.

Also, in the upright position (see FIGS. 1 and 5), the footrest linkage 83 of the reclining mechanism 30 is folded under the front portion of the seat 20, with the main footrest 29*a* generally vertically disposed just forward of the seat 20, and the auxiliary footrest 29*b* generally vertically disposed rearward of the main footrest 29*a*. The rear seat swing link 196 and the forward seat swing link 202 are both disposed generally upright. The rear recline link 174 and the front recline link 208 are also disposed generally upright, but with a rearward lean. Both the transition link 178 and the drawing link 186 are tilted generally forwardly. The carrier link 190 is generally horizontal and generally centered longitudinally relative to the foundation bracket 152. The seat frame 22 has a slight pitch (between about 2 and 7 degrees). The backrest 24 is tilted slightly rearwardly (at an angle of between about 105 and 120 degrees relative to horizontal), with the upper portion of the backrest 24 adjacent the upper cross-member 18.

Figure 11:
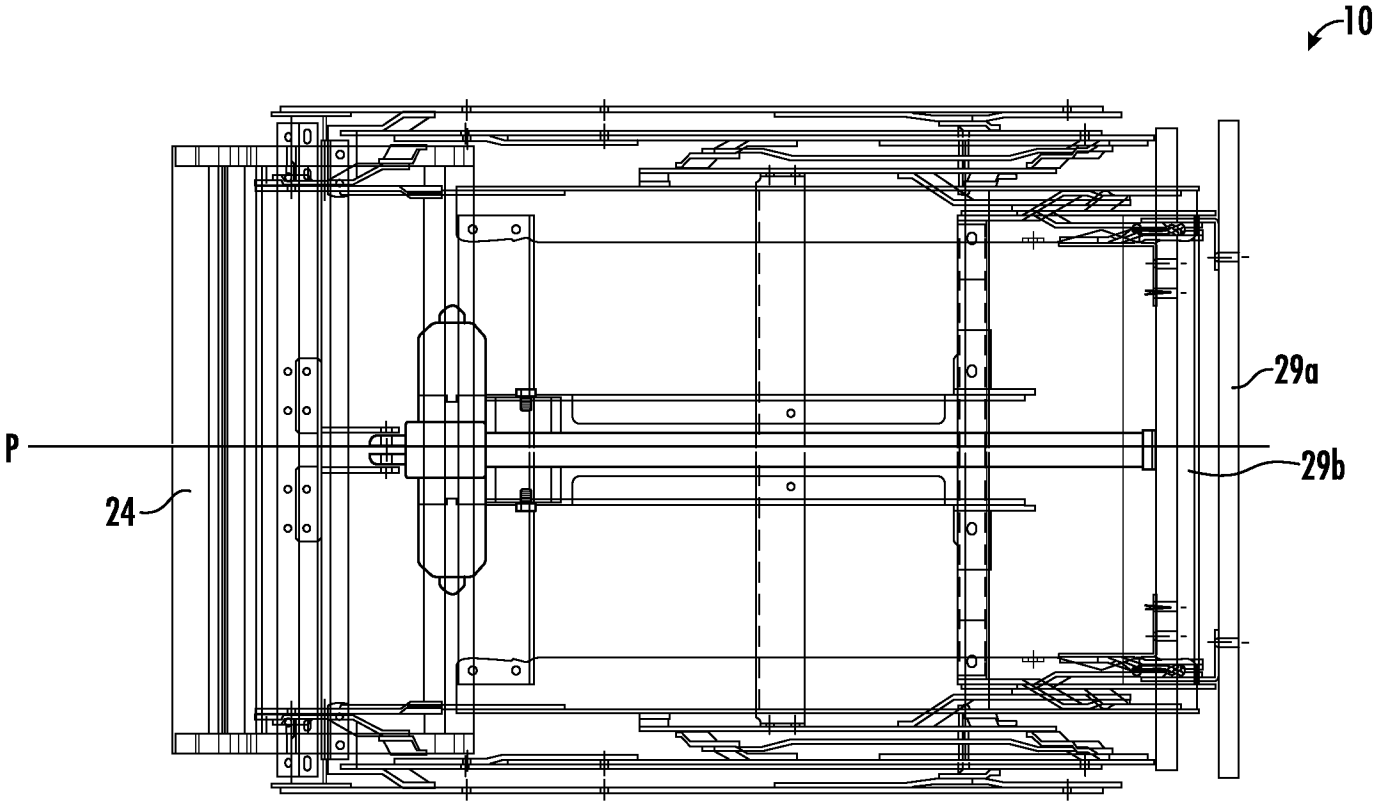
FIG. 11 is a top view of the chair of FIG. 1 shown in the upright position.

In some embodiments, the arrangement of the footrest mechanism 83 can enable the main and auxiliary footrests 29*a*, 29*b* to be the same (or nearly the same) width (e.g., substantially the full width of the chair 10). This arrangement is shown in FIG. 11, wherein the auxiliary footrest 29*b* is nearly the same width (within 1-2 inches) as the main footrest 29*a*. This is due to the fact that, in the upright position shown in FIGS. 1 and 5, there are no links of the reclining mechanism 30 positioned directly in front of the auxiliary footrest 29*b* that could prevent it from traveling forwardly (see also FIG. 11). This is in contrast to many prior chairs, in which the auxiliary footrest 29*b* is shorter in width than the main footrest 29*a* because links controlling the extension and retraction of the main footrest 29*a* are positioned directly in front of the auxiliary footrest 29*b* and therefore would interfere with its extension if the auxiliary footrest 29*b* were nearly as wide as the main footrest 29*a*.

To move the chair 10 to the TV position of FIGS. 2 and 6, the occupant of the chair 10 activates the linear actuator 311, which causes the carriage 313 to move forwardly on the rail 312. This action forces the drive member 314 forwardly, which in turn drives the crank 316 forwardly. Forward movement and counterclockwise rotation of the crank 316 causes the lower footrest swing link 84 to rotate counterclockwise about the pivot 85. The movement of the lower footrest swing link 84 drives the upper footrest extension link 92 forwardly, which in turn rotates the upper footrest swing link 88 about the pivot 90. Rotation of the upper footrest swing link 88 drives the lower footrest extension link 96 forwardly and causes it to separate slightly from the upper footrest extension link 92. The relative movement of the upper and lower footrest extension links 92, 96 rotates the main ottoman bracket 100 counterclockwise to a generally horizontal position. Relative rotation of the main ottoman bracket 100 and the lower footrest extension link 96 also forces the control link 106 away from the main footrest bracket 100, which extends the upper auxiliary footrest swing link 116 and, in turn, the auxiliary footrest bracket 120. Extension ceases when the upper footrest swing link 88 strikes a pin 92*a* on the upper footrest extension link 92. Additional aspects of the extension of the footrests 29*a*, 29*b* may be discussed in U.S. Pat. No. 8,752,890 to Murphy et al., the disclosure of which is hereby incorporated herein by reference in its entirety.

In addition, rotation of the lower footrest swing link 84 creates a rearwardly-directed force on the footrest drawing link 138, which is also directed to the carrier link 190 at the pivot 146. However, the carrier link 190 is prevented from rearward movement by the weight of the occupant of the chair; thus, an oppositely-directed forward reaction force is imposed on the seat frame 22. As a result, the seat frame 22 (and the remainder of the seat 20) move forwardly relative to the carrier link 190 (and, in turn, relative to the frame 12 along with the foundation link 152 and the heart-carriage link 274 mounted thereto). The forward movement of the seat frame 22 is controlled by the rear and front seat swing links 196, 202. The forward movement of the seat frame 22 also rotates the lower rear swing link 154 clockwise about the pivot 156. The rear end of the seat frame 22 descends, thereby increasing the pitch angle of the seat 20 by 2 to 10 degrees. The backrest 24 maintains its angle relative to the seat 20. This action ceases when a pin 22*a* on the seat frame 22 strikes the rear edge of the rear intermediate swing link 196.

Notably, the length and upright to slightly rearward disposition of the rear and front intermediate swing links 196, 202 enables the seat 20 to move forwardly a greater distance than previous chairs. In some embodiments, the forward movement of the seat 22 relative to the frame 12 is between about 2.5 and 4 inches, which occurs with substantially no relative movement between the carrier link 190 and the frame 12.

To move the chair 10 from the TV position of FIGS. 2 and 6 to the fully reclined position of FIGS. 3 and 7, the occupant of the chair 10 activates the linear actuator 311 to move the carriage 313 farther forward on the rail 312. This movement urges the seat frame 22 forward. Because the seat frame 22 and carrier link 190 are unable to move relative to each other, forward movement of the seat frame 22 also drives the carrier link 190 forwardly relative to the foundation link 152. This movement is controlled by the rear recline link 174 and the front recline link 208, which pivot clockwise relative to the foundation link 152 about pivots 176, 212. The rotation of these recline links 174, 208 forces the carrier link 190 forward via the transition link 178 and the drawing link 186, which are attached to the carrier link 190. Forward movement of the carrier link 190 in turn moves the seat frame 22 forward. This movement continues until the rear recline link 174 contacts a pin 152*a* on the foundation link 152.

The forward movement of the seat frame 22 also drives the backpost 165 (and backrest 24) counterclockwise about the pivot 172. This rotation first causes the lower rear swing link 154 to fully extend forwardly, at which point the upper rear swing link 158 rotates clockwise about the pivot 160. This movement raises the rear end of the seat frame 22 and also causes the backrest 24 to move to a reclined position (i.e., a position with an increased angle relative to the seat 20).

In moving from the TV position to the fully reclined position, the seat frame 22 moves forwardly relative to the frame 12 between about 4 and 7 inches, which occurs with substantially no relative forward movement between the seat frame 22 and the carrier link 190. When this distance is combined with the forward movement of the seat frame 22 relative to the frame 12 in moving from the upright position to the TV position, the total distance may be as much as 6.5 to 11 inches. Importantly, as can be seen in FIG. 3, this degree of movement can enable the backrest 24 to reach the fully reclined position even with the presence of the rear cross-member 18 (i.e., the uppermost end of the backrest 24 is positioned forwardly of the rear cross-member 18). As such, a chair according to embodiments shown herein can have wall-proximity capability even with a chair that has a fully formed back, which is often the case with chairs that are fully upholstered in the rear.

In addition, this configuration also enables the use of a deeper seat frame 22, which can provide more room front-to-back for sitting, laying down, napping, etc. Further, in some embodiments, a unitary upholstery piece (e.g., a cushion or pad) can be used to cover the seat and the footrests 29*a* and to attach to the footrest 29*b*. As an example, the pad can be attached to the rear end of the seat 20, extend forwardly to cover the seat 20, extend downwardly to cover the front surface of the main footrest 29*a*, and extend below the main footrest 29*a* and rearwardly to attach to the upper edge of the auxiliary footrest 29*b*. Extension/retraction of the footrests 29*a*, 29*b* and forward movement of the seat 20 are such that the pad can remain taut, but not overstretch, as these components move between positions.

Movement of the chair 10 between the upright, TV and fully reclined positions is controlled by the reclining mechanisms 30, with the heart-rest mechanisms 250 remaining stationary relative to the frame 12. However, when it is desired to move the chair 10 from the fully reclined position to the heart-rest position of FIGS. 4 and 8, the occupant activates the linear actuator 311 to drive the carriage 313 even further forward on the rail 312. Because the reclining mechanisms 30 are fully extended at this point, forward motion of the carriage 313 forces the heart-rest carriage link 274 and the foundation link 152 (which is fixed thereto) forwardly. As the heart-rest carriage link 274 moves forwardly, its movement is controlled by the rear swing link 264, which rotates counterclockwise about the pivot 266, and the front swing link 278, which rotates clockwise about the pivot 280. The rotation of the front swing link 278 forces the lifting link 282 upwardly and rotates it counterclockwise about the pivot 284. The action of the lifting link 282 causes the front end of the heart-rest carriage link 274 (and, in turn, the seat 22 and footrests 29*a*, 29*b*) to rise relative to the mounting link 262. The movement ceases (thereby enabling the chair 10 to reach the heart-rest position of FIGS. 4 and 8) when the carriage 313 reaches the front end of the rail 312. Notably, the footrests 29*a*, 29*b*, the seat 20, and the backrest 24 do not move relative to each other, but instead move forwardly and "tilt" in concert (e.g., the backrest 24 remains at the same angle relative to the seat 20, the footrests remain extended the same distance from the seat 20, etc.)

In the heart-rest position, the chair 10 is disposed so that the footrests 29*a*, 29*b* have risen between about 6 and 14 inches from their elevation in the fully reclined position. Also, the pitch angle of the seat 20 increases between about 10 and 15 degrees from its pitch angle in the fully reclined position; similarly, the reclining angle of the backrest 24 decreases between about 10 and 15 degrees. Thus, the feet of an occupant of the chair 10 are positioned well above the heart of the occupant to encourage blood flow to the heart.

Those of skill in this art will appreciate that seating units according to embodiments of the invention may take other forms. For example, while a chair is shown herein, the reclining mechanisms 30 and heart-rest mechanisms 250 may be employed in other seating units, such as love seats, sofas, sectional sofas, and the like.

Also, in other embodiments the actuating mechanisms may vary as desired, including both manually-operated units and other power-actuated units. For example, the "rail and carriage" linear actuator shown herein may be replaced by "sleeve and rod" or "telescoping" linear actuator.

Further, the chair 10 may have only one footrest, or may have three or more footrests in other embodiments. Other variations will be apparent to those of skill in this art.

Figure 12:
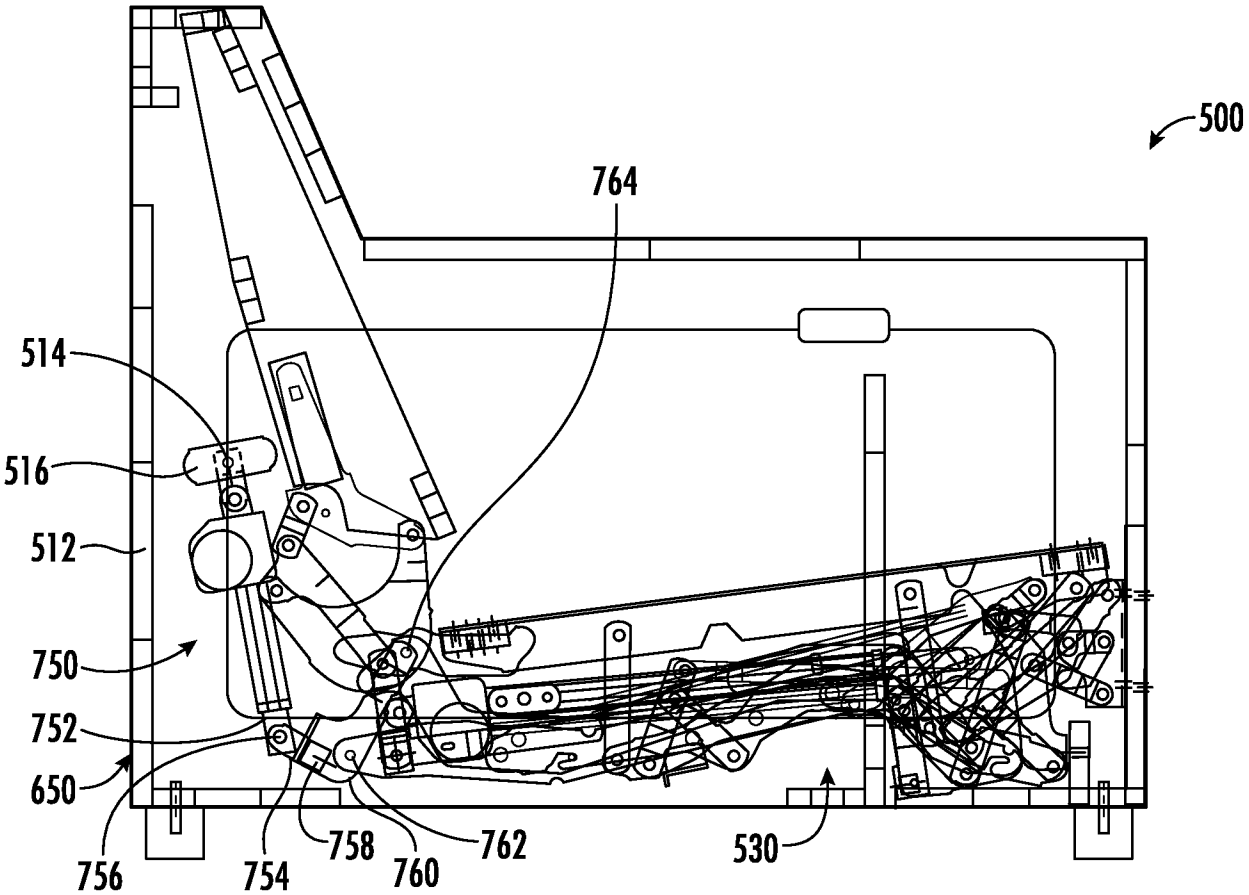
FIG. 12 is a cutaway side view of a reclining chair with heart-rest capability according alternative embodiments of the invention, with the chair shown in the upright position and the heart-rest mechanism retracted.
Figure 13:
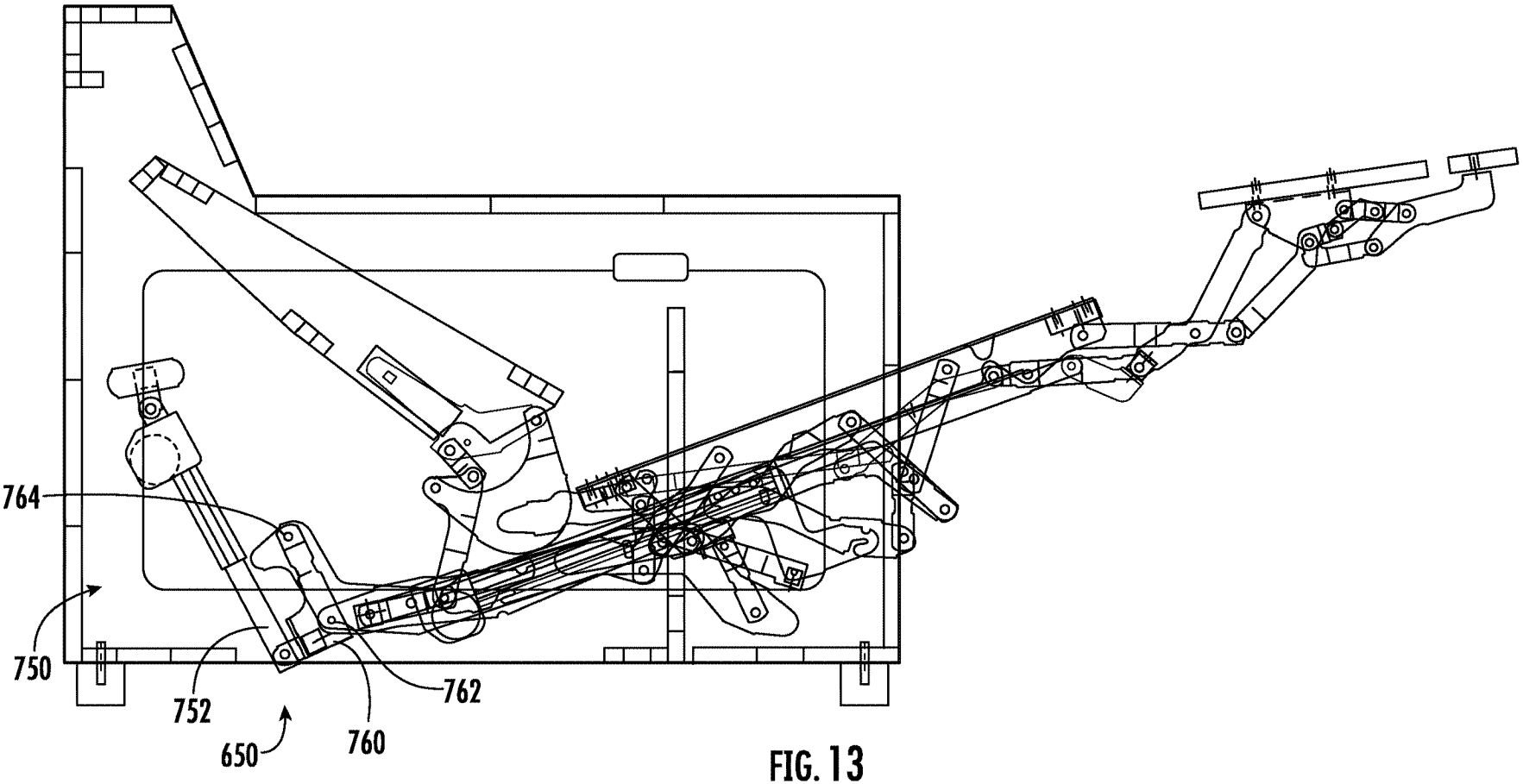
FIG. 13 is a cutaway side view of the chair of FIG. 12, shown with the backrest reclined and the heart-rest mechanism extended.
Figure 14:
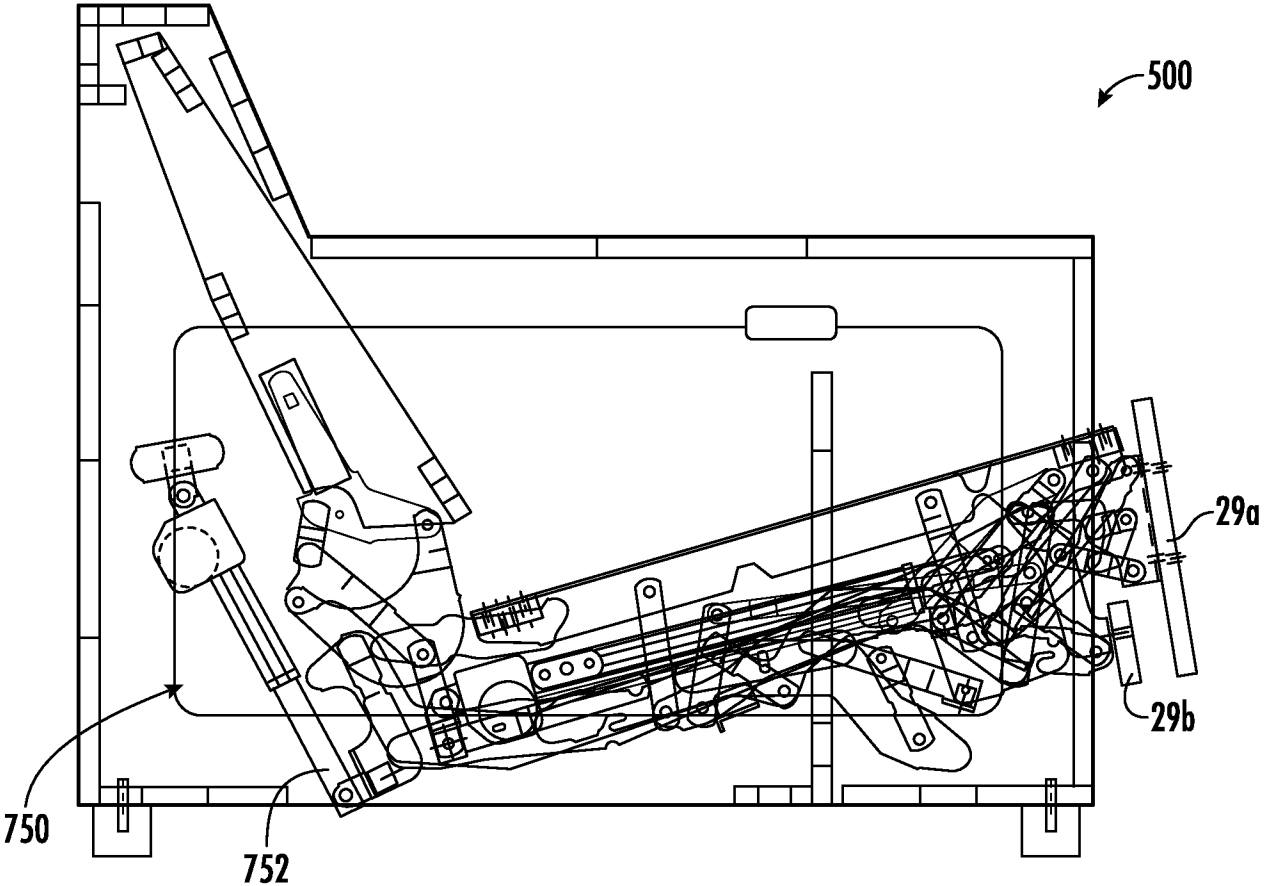
FIG. 14 is a cutaway side view of the chair of FIG. 12, shown with the footrest retracted and the heart-rest mechanism extended.
Figure 15:
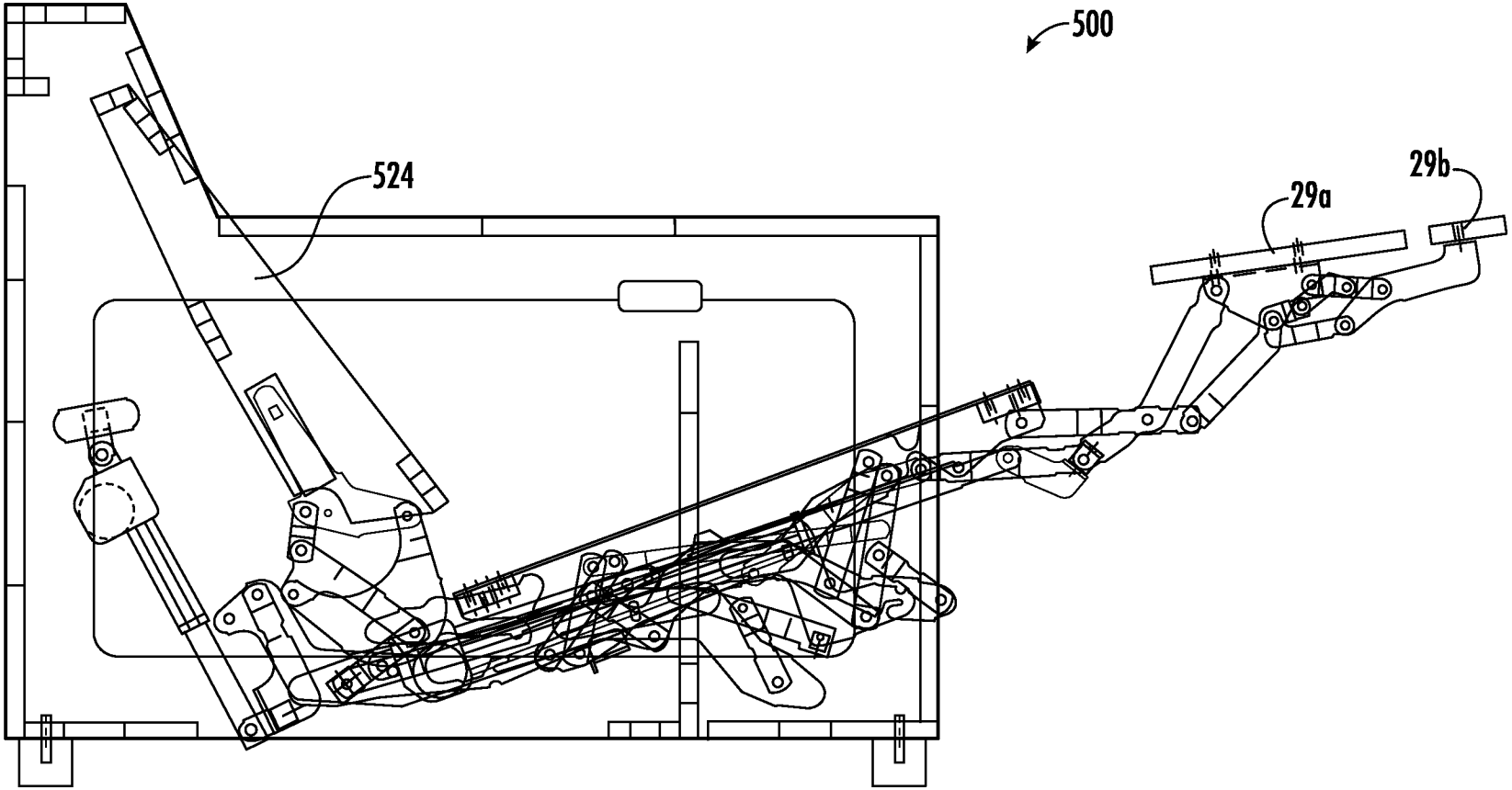
FIG. 15 is a cutaway side view of the chair of FIG. 12, shown with the footrest extended and the heart-rest mechanism also extended.

As another example, a chair, designated broadly at 500, is shown in FIGS. 12-15. The chair 500 has a reclining mechanism 530 that is similar to that of the chair 10; however, the heart-rest mechanism 650 is configured differently, and a second linear actuator 750 is employed. As shown in FIG. 12, the linear actuator 750 is pivotally mounted to the frame 512 at a pivot 514 via a small bracket 516. The linear actuator 750 is of the "sleeve and rod" configuration described above. The free end of the rod 752 is attached to a bracket 754 at a pivot 756. The bracket 754 is fixed to a cross-member 758 that is also fixed to a heart-rest drive link 760. The heart-rest drive link 760 is attached to the heart-rest carriage link 274 at a pivot 762 and to the mounting link 262 at a pivot 764.

In the upright position of FIG. 12, the rod 752 of the linear actuator 750 is retracted into the sleeve, and the heart-rest drive link 760 is disposed so that it extends upwardly and slightly forwardly from the pivot 762. Extension of the rod 752 from the sleeve forces the lower end of the heart-rest drive link 760 forward and rotates the heart-drive link 760 counterclockwise (from the vantage point of FIGS. 12 and 13). This action forces the heart-rest carriage link 274 forward relative to the mounting link 262 which has the effect of raising the footrests 529*a*, 529*b*, increasing the pitch of the seat 522, and reclining the backrest 524 (see FIG. 13).

Notably, the use of the second linear actuator 750 enables the chair 500 to be able to take positions controlled by the heart-rest mechanism 650 independently of the reclining mechanism 530. As such, in addition to the upright, TV, fully recline, and heart-rest positions shown in FIGS. 1-11 for the chair 10, the chair 500 can also take positions in which the heart-rest mechanism 650 is extended (a) while the footrests 529*a*, 529*b* are retracted (see FIG. 14) and (b) while the footrests 529*a*, 529*b* are extended but the backrest 524 is not reclined (see FIG. 15).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A reclining seating unit, comprising:

a frame having a pair of arms;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position; and a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position.

2. The reclining seating unit defined in claim 1, further comprising a back member extending between the arms.

3. The reclining seating unit defined in claim 1, wherein in the heart-rest position, the first footrest is elevated between about 6 and 14 inches higher than in the fully reclined position.

4. The reclining seating unit defined in claim 1, further comprising a second footrest, wherein the second footrest is attached to the reclining mechanism, wherein in the upright position the second footrest is disposed below the seat and behind the first footrest, and in the TV and fully reclined positions the second footrest is positioned forwardly of the first footrest.

5. The reclining seating unit defined in claim 4, wherein in the upright position the first footrest is vertically disposed.

6. The reclining seating unit defined in claim 1, further comprising a power linear actuator coupled to the reclining mechanism and to the heart-rest mechanism configured to drive the chair between the upright, TV, fully reclined and heart-rest positions.

7. The reclining mechanism defined in claim 1, wherein the reclining mechanism includes a foundation link, wherein the heart-rest mechanism is coupled to the foundation link, and wherein the foundation link is stationary relative to the frame as the seating unit moves between the upright, TV and fully reclined positions.

8. The reclining seating unit defined in claim 7, wherein, when moving from the fully reclined position to the heart-rest position, the foundation link moves forwardly and upwardly relative to the frame.

9. A reclining seating unit, comprising:

a frame having a pair of arms;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position;

a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position; and a single power linear actuator coupled to the reclining mechanism and to the heart-rest mechanism configured to drive the chair between the upright, TV, fully reclined and heart-rest positions.

10. The reclining seating unit defined in claim 9, further comprising a back member extending between the arms.

11. The reclining seating unit defined in claim 9, wherein in the heart-rest position, the first footrest is elevated between about 6 and 14 inches higher than in the fully reclined position.

12. The reclining seating unit defined in claim 9, further comprising a second footrest, wherein the second footrest is attached to the reclining mechanism, wherein in the upright position the second footrest is disposed below the seat and behind the first footrest, and in the TV and fully reclined positions the second footrest is positioned forwardly of the first footrest.

13. The reclining seating unit defined in claim 12, wherein in the upright position the first footrest is vertically disposed.

14. The reclining mechanism defined in claim 9, wherein the reclining mechanism includes a foundation link, wherein the heart-rest mechanism is coupled to the foundation link, and wherein the foundation link is stationary relative to the frame as the seating unit moves between the upright, TV and fully reclined positions.

15. The reclining seating unit defined in claim 14, wherein, when moving from the fully reclined position to the heart-rest position, the foundation link moves forwardly and upwardly relative to the frame.

16. A reclining seating unit, comprising:

a frame having a pair of arms;

a backrest;

a seat;

a first footrest;

a reclining mechanism connected between the backrest, seat, and first footrest, the reclining mechanism comprising a series of pivotally interconnected links and configured to move the seating unit between: (a) an upright position, in which the backrest is disposed at a first generally upright backrest angle relative to the seat, the seat is disposed at a first generally horizontal seat angle, and the first footrest is retracted below a forward portion of the seat; (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle relative to the seat that is larger than the first backrest angle, the first footrest remains extended in front of the seat, and the seat is moved forward of its position in the TV position; and a heart-rest mechanism mounted to the frame and to the reclining mechanism, the heart-rest mechanism comprising a series of pivotally interconnected links and configured to move the seating unit between the fully reclined position and a heart-rest position, wherein the backrest maintains the second backrest angle relative to the seat, the first footrest remains in front of the seat, and the seat and first footrest are elevated compared to the fully reclined position;

wherein the reclining mechanism includes a foundation link, wherein the heart-rest mechanism is coupled to the foundation link, wherein the foundation link is stationary relative to the frame as the seating unit moves between the upright, TV and fully reclined positions, and wherein, when moving from the fully reclined position to the heart-rest position, the foundation link moves forwardly and upwardly relative to the frame; and wherein the seating unit further comprises a power linear actuator coupled to the reclining mechanism and to the heart-rest mechanism configured to drive the chair between the upright, TV, fully reclined and heart-rest positions.

17. The reclining seating unit defined in claim 16, further comprising a back member extending between the arms.

18. The reclining seating unit defined in claim 16, wherein in the heart-rest position, the first footrest is elevated between about 6 and 14 inches higher than in the fully reclined position.

19. The reclining seating unit defined in claim 16, further comprising a second footrest, wherein the second footrest is attached to the reclining mechanism, wherein in the upright position the second footrest is disposed below the seat and behind the first footrest, and in the TV and fully reclined positions the second footrest is positioned forwardly of the first footrest.

20. The reclining seating unit defined in claim 19, wherein in the upright position the first footrest is vertically disposed.

* * * * *